US006546976B1

(12) United States Patent
Hill

(10) Patent No.: US 6,546,976 B1
(45) Date of Patent: Apr. 15, 2003

(54) COMPUTER DESIGNED ERGONOMIC UPRIGHT WOOD SPLITTER SYSTEMS AND METHODS

(76) Inventor: Norman M. Hill, 17417 28th Ave. NE., Bothell, WA (US) 98012

( * ) Notice: Subject to any disclaimer, the term of this patent is extended or adjusted under 35 U.S.C. 154(b) by 0 days.

(21) Appl. No.: 10/081,334

(22) Filed: Feb. 20, 2002

(65) Prior Publication Data

(65)

(51) Int. Cl.[7] ..... B27L 7/00

(52) U.S. Cl. ..... 144/195.1; 144/195.8; 144/366

(58) Field of Search ..... 144/193.1, 195.1, 144/195.8, 366

(56) References Cited

U.S. PATENT DOCUMENTS 401,866 A * 4/1889 Stearns ..... 144/193.1
508,221 A * 11/1893 Hill ..... 144/195.1
845,954 A * 3/1907 Hildreth ..... 144/193.1
2,851,072 A * 9/1958 Gerjets et al. ..... 144/195.1
3,097,676 A * 7/1963 Calk ..... 144/195.1
3,802,473 A * 4/1974 Carr ..... 144/193.1
4,334,562 A * 6/1982 Granlund ..... 144/195.1
6,076,576 A1 6/2002 Maddox et al.

OTHER PUBLICATIONS

Norman M. Hill, *Hydraulic Firewood Splitter Satisfying the Requirements of the Modern World*; pp. 1–21.
Norman M. Hill, *Belief vs. Fact, Understanding why the Summit Splitter is Inventive Art by satirizing the preconceived notions and prejudices of "those already skilled in the art" of hydraulic wood splitter design*; Dec. 15, 2001; pp. 1–11.

* cited by examiner

*Primary Examiner*—W. Donald Bray
(74) *Attorney, Agent, or Firm*—Michael R. Schacht; Schacht Law Office, Inc.

(57) ABSTRACT

A wood splitter comprising a support structure, a table assembly, a ram assembly, and wedge member, and a control means. The support structure supports the table assembly. The control system energizes the ram assembly to force the wedge towards the table assembly. A workpiece is placed on the table assembly such that the wedge engages and splits the workpiece.

45 Claims, 8 Drawing Sheets

COMPUTER DESIGNED ERGONOMIC UPRIGHT WOOD SPLITTER SYSTEMS AND METHODS

TECHNICAL FIELD

The present invention relates to systems and methods for splitting wood into smaller pieces for use as firewood and, more specifically, to such systems and methods that use a motorized wedge to split wood rounds into firewood.

BACKGROUND OF THE INVENTION

Wood is often burned as a heat source and in many situations is burned to create an enhanced ambiance. Most people who have the desire to burn wood do not have a ready source of logs or the equipment or time to saw the logs into rounds and/or split the rounds into firewood. Accordingly, firewood is commonly sawn and split at one location and then sold by the cord (usually delivered) or smaller quantity to the end user.

Motorized systems have long been used to reduce the amount of effort required to split wood rounds into firewood. Conventional motorized wood splitters typically comprise a horizontal or vertical I-beam having a hydraulic actuator securely mounted on one end and a small stop member mounted on the other end. The hydraulic actuator is connected to a wedge member, and extension and retraction of the hydraulic actuator extends the wedge member towards and away from the stop member. Typically, a guide track is provided for the wedge member.

The wood round to be split, or workpiece, is placed on its side on the I-beam against the stop member. The actuator is energized to force the wedge member into the workpiece and split the wood into separate pieces.

Conventional motorized wood splitters do not define a clear work surface on which the workpiece is placed. In addition, the I-beam is very close to the ground, requiring the operator to bend over almost continuously while working. The proximity of the I-beam and any guide track for the wedge member significantly interfere with placement of the workpiece in a desired orientation on the wood splitter. Even then, the placement of the curved outer surface of the wood round on the flat upper surface of the I-beam is inherently unstable.

Commonly, the split pieces fall to the ground after each split and must be lifted back onto the I-beam if smaller pieces are desired. This can prematurely fatigue the operator and slow down the splitting process.

In addition, the wedge surfaces of the wedge member face the operator. If the workpiece should spring apart suddenly when split, the split pieces may eject towards the operator, and conventional wood splitters do not protect the operator from the ejected split pieces.

The use of an undersized work surface also encourages the operator to prop the workpiece by hand on the work surface while the split is being made; conventional wood splitter systems thus encourage the operator to take risks while splitting the wood.

Conventional wood splitter systems typically use a gasoline engine. Typically, engines in the range of five to twelve horsepower are used because of inefficiencies in the system for carrying the wedge. Inefficiencies include binding, which is the inability of wedge to freely rotate if splitting through spiraling, and non-straight wood grains and long travel times due to mis-dimensioning. Gasoline engines are loud and emit fumes; prolonged exposure to the noise and fumes created by gasoline engines can create operator fatigue or possibly even illness.

The wedges of conventional wood splitters are typically operated at a fairly high speed because of the distance that the wedge member is required to travel during splitting. These relatively high speeds increase the likelihood of injury to the operator by direct engagement with the moving wedge member or by a moving piece of wood thrown off during the splitting process.

In addition, the relatively long slide distance of conventional wood splitters encourages undersawing and/or undersplitting of the wood rounds, resulting in finished product that is too large in length and/or girth for many woodburning appliances.

Conventional wood splitter systems thus eliminate the need to drive a wedge through wood by hand to split a wood round into firewood but create a host of problems that make this process inconvenient at best. The inconveniences associated with conventional wood splitter systems result in the operator attempting to minimize the splitting process by sawing the wood rounds too long and/or undersplitting the wood rounds. A significant amount of the final firewood product that is created using conventional wood splitter systems is thus not properly sized and dimensioned for practical use in conventional woodburning appliances. At the same time, the operator is being subjected to considerable annoyance and inefficiencies due to the limitations and non-ergonomic nature of the machine. The operator is also subjected to significant health hazards as discussed above.

SUMMARY OF THE INVENTION

The present invention is a wood splitter comprising a support structure, a table assembly, a ram assembly, and wedge member, and a control means. The support structure supports the table assembly. The control system energizes the ram assembly to force the wedge towards the table assembly. A workpiece is placed on the table assembly such that the wedge engages and splits the workpiece.

DETAILED DESCRIPTION OF THE INVENTION

Figure 1:
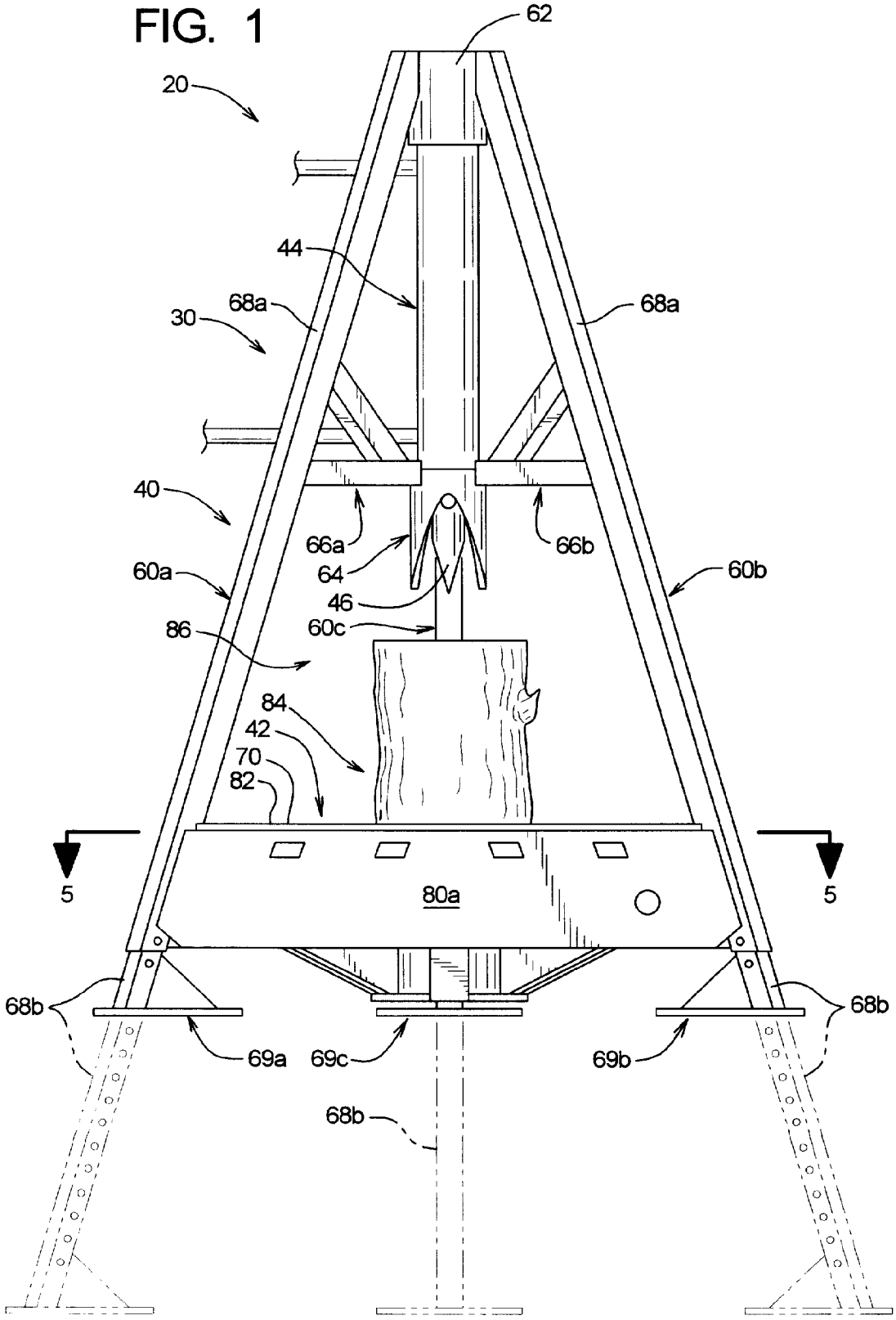
FIG. 1 is a front elevation view of a wood splitter system of the present invention.

Referring initially to FIG. 1, depicted at 20 is a wood splitter system constructed in accordance with, and embodying, the principles of the present invention. In the following discussion, the basic construction and operation of the wood splitter 20 will first be described, after which will follow a more detailed discussion of the major systems and subsystems of the exemplary wood splitter 20 depicted in the drawings.

I. Basic Operation

Figure 3:
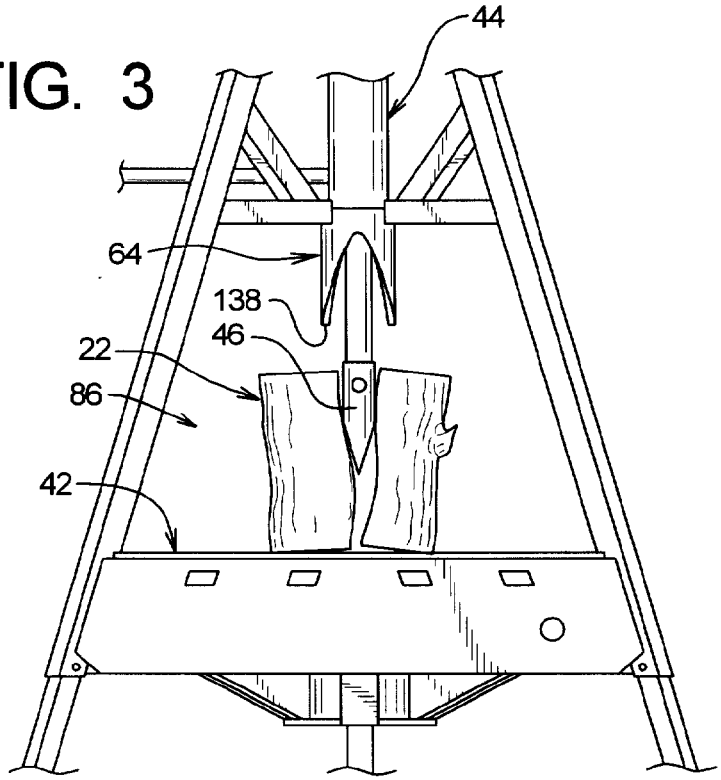
FIG. 3 is a partial elevation view of the wood splitter system of FIG. 1 being used to split a workpiece.
Figure 10:
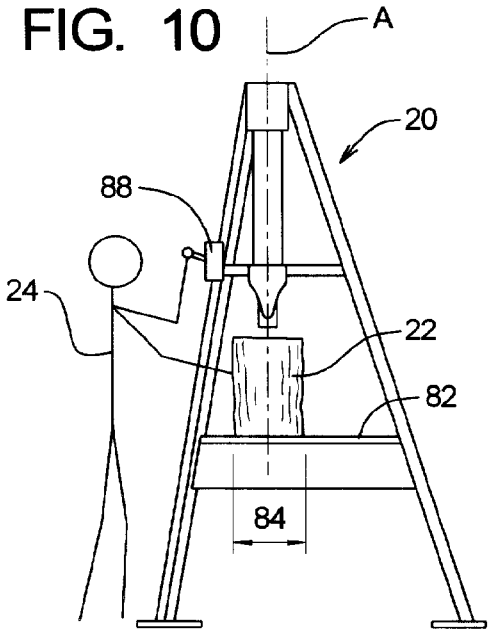
FIG. 10 is a side elevation view depicting the operation of the wood splitter system of FIG. 1 in a split mode.

The wood splitter 20 can be placed in a split mode or in a tow mode. In the split mode (FIGS. 3, 4, and 10), the splitter 20 is upright and is used to split a workpiece 22; typically, the workpiece 22 is a round of wood to be split into smaller pieces that may be burned as firewood. An operator 24 is shown in FIG. 10 operating the splitter 20 in the split mode.

Figure 2:
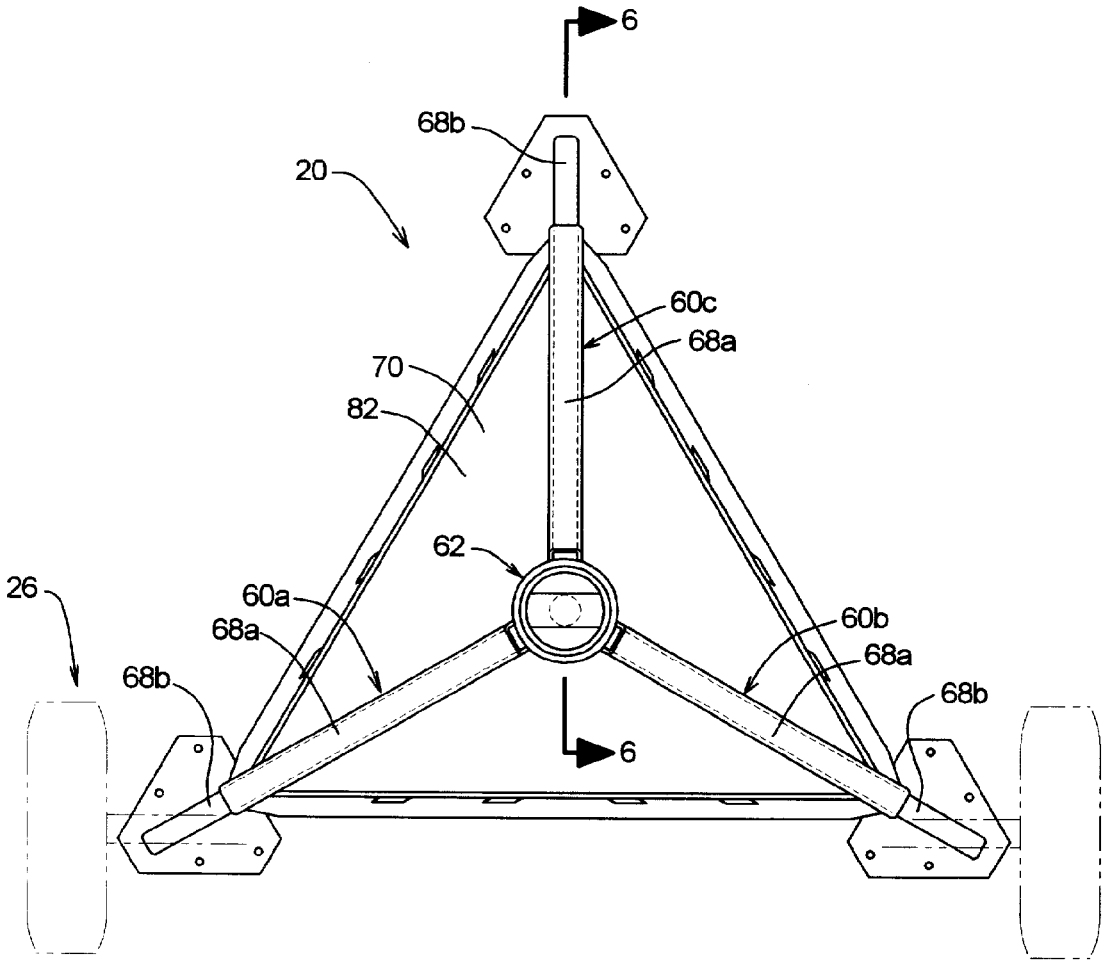
FIG. 2 is a top plan view of the wood splitter system of FIG. 1.
Figure 9:
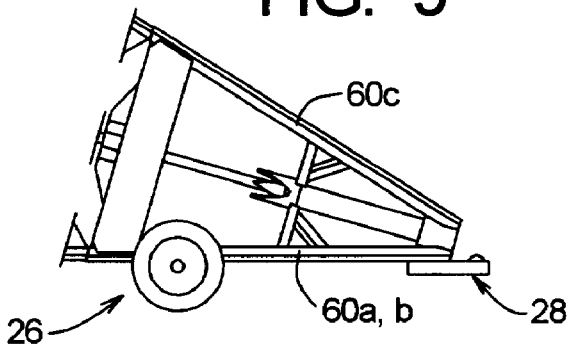
FIG. 9 is a side elevation view depicting the wood splitter system of FIG. 1 in a tow mode.

In the tow mode as shown in FIG. 9, the exemplary wood splitter 20 is placed in a prone position. A wheel assembly 26 and tongue assembly 28 are attached thereto as shown in FIG. 2. When in the tow mode, the wood splitter 20 may be towed by a separate vehicle in a conventional fashion. In another embodiment, the wood splitter 20 may be towed in its upright position. In either situation, the wheel assembly 26 and/or tongue member 28 may be detachable or permanently attached. The wheel assembly 26 and the tongue assembly 28 are or may be conventional and will not be described herein in detail.

Figure 5:
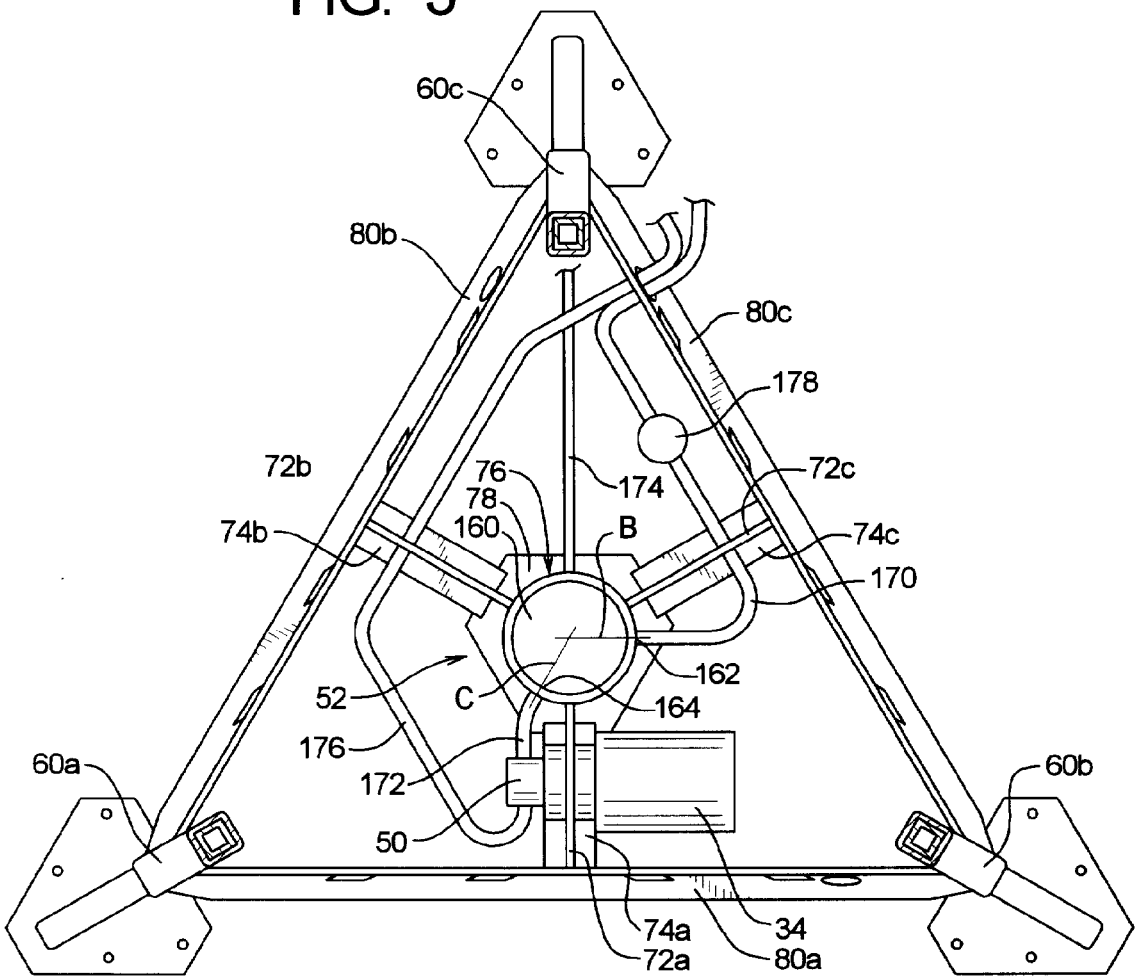
FIG. 5 is a top plan cutaway view of the table assembly depicting a portion of the hydraulic control system used by the wood splitter system of FIG. 1.

The wood splitter 20 of the present invention comprises a mechanical system 30 (FIG. 1), a control system 32 (FIG. 17), and a motor 34 (FIG. 5). The motor 34 provides power to the control system 32, and the control system 32 converts this power into movement of the mechanical system 30 such that the mechanical system 30 engages and splits the workpiece 22.

The exemplary mechanical system 30 comprises a support structure 40, a table assembly 42, a ram assembly 44, and a wedge member 46. The support structure 40 supports the table assembly 42 at a desired location and the ram assembly 44 in a fixed relationship to the table assembly 42. The ram assembly 44 supports the wedge member 46 for movement along a ram axis A defined by the ram assembly 44.

Figure 17:
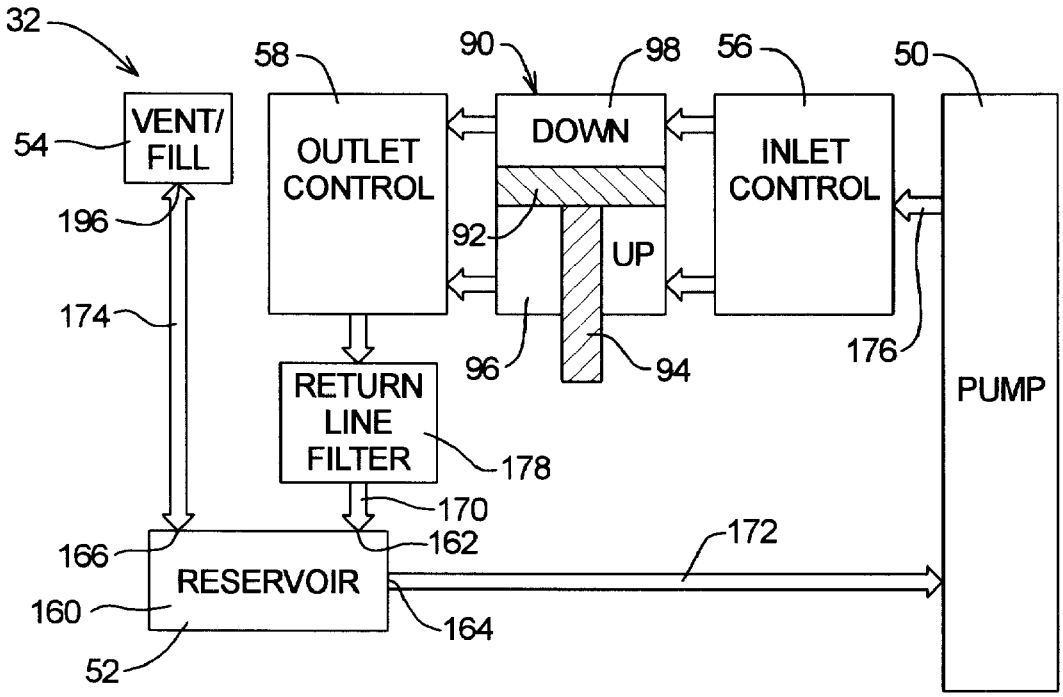
FIG. 17 is a schematic block diagram depicting the control system of the exemplary wood splitter system of FIG. 1.

As shown in FIG. 17, the exemplary control system 32 comprises a pump 50, a reservoir 52, a vent/fill system 54, an inlet control valve assembly 56, and an outlet control valve assembly 58. The pump 50 is connected to the motor 34 such that operation of the motor 34 provides power to the pump 50. The motor 34 and pump 50 are or may be conventional and will not be described herein in detail.

The pump 50 is in turn connected to the ram assembly 44 through an inlet control valve assembly 56. The ram assembly 44 is in turn connected to the reservoir 52 through the outlet control valve assembly 58. The ram assembly 44 and control valve assemblies 56 and 58 also are or may be conventional and allow the ram assembly 44 to force the wedge member 46 along the ram axis A into the workpiece 22 to split the workpiece 22. The ram assembly 44 and control valve assemblies 56 and 58 are conventional and will be described herein only to the extent necessary for a complete understanding of the present invention.

With the foregoing general understanding of the present invention, the details of construction of the mechanical and control systems 30 and 32 and operation of the wood splitter system 20 will now be described in detail.

II. Mechanical System

The mechanical system 30 basically forms a rigid structure for splitting the workpiece 22 while the system 20 is in the split mode and for forming a carriage frame when the system 20 is in the tow mode. Each of the major components of the exemplary mechanical system 30 will be described below.

A. Support Structure

The exemplary support structure 40 of the mechanical system 30 is a welded steel assembly that supports the ram assembly 44 and the table member 42 such that wood splitter system 20 may split the workpiece by forcing the wedge member 46 towards the table assembly 42. The support structure 40 must be a sufficiently rigid to maintain a fixed distance between the fixed portion of the ram assembly 44 and the table member 42 when the workpiece is being split. The details of construction of the support structure are not critical to the present invention in its broadest form. The exemplary support structure 40 has, however, been very carefully designed for peak function and efficient manufacturing and will now be described in 10 further detail.

The exemplary support structure 40 comprises a plurality of legs 60*a,b,c,* an upper collar 62, a lower collar 64, and a plurality of bracing assemblies 66*a,b,c*. The upper collar 62 joins together the upper ends of the legs 60*a,b,c* at a support location such that the legs are angled with respect to each other. The bracing assemblies 66*a,b,c* extend between each of the legs 60*a,b,c* respectively and the lower collar 64. The ram assembly 44 is supported by the upper and lower collars 62 and 64 such that the wedge member 46 is suspended from the ram assembly 44 below the support location.

The exemplary support structure 40 comprises three legs 60, and the Applicant believes that this arrangement enhances such considerations as stability, weight, height, width, strength, operator access, and manufacturing. It may, however, be possible to practice the principles of the present invention in its broadest form with a one or two legged support structure or a support structure with four or more legs.

In addition, for reasons that will be clear from the following discussion, two of the legs 60 are identified as front legs 60*a,b* and the third is identified as rear leg 60*c*.

The legs 60 may be made adjustable. In particular, the legs 60 each may comprise a fixed leg member 68*a* and a movable leg member 68*b*. The fixed leg members 68*a* are welded to the upper collar 62, the lower collar 64, and the table assembly 42 as will be described in detail below. The fixed leg members 68*a* thus restrain the tension loads created when the system 20 is in use.

The movable leg members 68*b* are sized and dimensioned to telescope within the fixed leg members 68*a*. In addition, a ground engaging plate 69 is rigidly connected to each of the leg members 68*a*. A locking mechanism such as a rigid pin or the like may be used to fixed a desired distance between the table assembly 42 and a ground engaging plate 69 welded to the bottom of each of the movable leg members 68*b*.

If the telescoping fixed and movable leg members 68*a* and 68*b* are used, the legs 60 may be adjusted to raise or lower a height of the table assembly 42 and/or to substantially level the table assembly 42 when the system 20 is used on uneven ground.

The bracing assemblies 66 are welded between the legs 60, and in particular the fixed leg members 68*a,* and the lower collar 64. The exemplary bracing assemblies 66 support the collar 64 at a center location above the table assembly 42. The collar 64 in turn supports the ram assembly 44 such that the wedge member 46 moves only along the ram axis A.

The fixed leg members 68*a* operate primarily in tension while the system 20 is used to split the workpiece 22. The tension carried by each of the individual fixed leg members 68*a* is substantially equal for a straight grained workpiece 22. If the workpiece has a canted or twisted grain, the leg members 68 may bear side loads that are substantially converted into varying tension levels within each of the fixed leg members 62*a*. Additionally, the legs 60 obviate the need for a guide system for the wedge member 46 and a heavy structural member such as an I-beam to support the guide.

As discussed above, the support structure of the present invention in its broadest form may be embodied in forms other than the exemplary support structure 40 described in this section. However, the support structure 40 is highly efficient for use in the wood splitter system 20 and is preferred for at least the following reasons.

The tapered or canted legs 60 create a structure that is not top heavy and thus very stable. The structure 40 is sufficiently rigid for use of the system 20 in both the split mode and in the tow mode. The legs 60 obviate the need for a large overhead structural member and reduce interference by the support structure 40 with the placement of the workpiece 22 on the table assembly 42. The support structure 40 also allows the fixed leg members 68*a* to operate primarily in tension. The legs 60 thus may be of lightweight structure; such a lightweight structure would be damaged if used in a conventional wood splitter system.

B. Table Assembly

The table assembly 42 is a rigid member or assembly of sufficient strength to bear the pressure applied by the workpiece 22 when the ram assembly 44 forces the wedge member 46 against the workpiece 22. Again, the details of construction of the table assembly 42 are not critical to the invention in its broadest form, but the exemplary table assembly 42 disclosed herein has been designed for efficient operation and manufacturing of the wood splitter 20.

As perhaps best shown in FIGS. 1 and 5, the exemplary table assembly 42 comprises an upper member 70 (FIG. 6), a plurality of web members 72 (FIG. 18), a flange member 74 for each web member, a core member 76, a container plate 78, and a plurality of edge members 80.

For symmetry and balance, the upper member 70 is formed substantially in the shape of an equilateral triangle, and the number of web members 72 and edge members 80 is the same as the number of legs 60. Accordingly, in the wood splitter system 20 the vertices of the triangular upper member 70 are arranged at the leg members 60. In addition, this exemplary configuration suggests the use of three web members 72*a,b,c,* three flange members 74*a,b,c,* and three edge members 80*a,b,c*. However, the shape of the upper member 70 and the number of web members 72, flange members 74, and edge members 80 can vary in different embodiments of the present invention.

The upper member 70 defines a work surface 82 on which the workpiece 22 is placed when the splitter system 20 is in the split mode. Generally defined on the work surface 82 below the ram assembly 44 along the ram axis A is a work location 84. The workpiece 22 is arranged at the work location 84 when being split. The work location 84 is the central strike point for downward splitting forces in line with ram axis A; as described above, the exemplary table assembly 42 is capable of supporting a ram force of at least 36,000 pounds. At the work location 84, a center reinforcement 87 is arranged underneath the upper member 70 so that the work location 84 is capable of supporting a higher pressure of up to approximately 72,000 pounds per square inch.

The support structure 40 and table assembly 42 define a work opening 86. The work opening 86 is defined on the side by the front legs 60*a,b,* on the bottom by the upper member 70, and at top by the wedge member 46 in its upper position (FIG. 1). While a workpiece may be placed on the work surface 82 through the opening defined by the upper member 70 and any adjacent pair of the legs 60, the workpiece 22 is preferably and most conveniently placed onto the work surface 82 through the work opening 86.

The height dimension defined by the work opening 86 limits the height of the workpiece 22 (length of the round of wood) that may be split using the wood splitter system 20. This height limit is important for several reasons. First, a workpiece 22 that does not fit into height limitation defined by the work opening 86 is likely too long for many wood burning appliances. The height limitation of the work opening 86 thus results in a more uniform, high quality final product.

Second, the height limitation defined by the work opening 86 dictates the distance that the wedge member 46 must travel to split the workpiece 22. Limiting this distance allows the motor 34, ram assembly 44, and pump 50 to be matched in a manner that allows the relatively small electric motor 34 to be used as the prime mover of the system 20. The limited travel distance of the wedge member 46 also reduces the travel speed required of the wedge member 46 to obtain a desired maximum split rate.

The result of the limit on the height of the workpiece 22 is that the motor 34 of the exemplary wood splitter system 20 of the present invention may be a two-horse electric motor rather than a gasoline powered engine of five to twelve horsepower as would have been used by conventional wood splitter systems.

The motor 34, when coupled with the pump 50, generates a traverse rate of the wedge member 46 of approximately 1.6 inches per second during extension and 2.2 inches per second while retracting. These rates yield a split cycle of approximately seven seconds for a typically splitting operation. While this traverse rate is slower than conventional wood splitters, the relatively short travel distance and other efficiencies of the system 20 yield increased output.

Referring now to FIG. 10, depicted therein is a control unit 88 for controlling operation of the ram assembly 44. The control unit 88 is preferably mounted near the bracing assemblies 66 above the work opening 86, but the control unit 88 may be mounted at other locations.

The operator 24 may operate the control unit 88 with one hand while manipulating the workpiece 22 with the other hand. The control unit 88 is preferably biased such the wedge member 46 stops if the hand of the operator 24 is removed from the control unit 88.

As generally shown in FIG. 10, the work surface 82 is preferably arranged to a level convenient for the operator 24. Typically, the work surface 82 should be at a height substantially between the ankles and the waist of an average size adult male. The adjustable legs 60 described herein allow the operator 24 to alter the height of the work surface 82 as appropriate for a particular operator 24.

As shown in FIGS. 1 and 5, the edge members 80 are welded along their upper edge to the upper member 70 and at their ends to the legs 60 and in particular to the fixed leg members 68*a*. These edge members 80 thus provide support to edges of the upper member 70. The edge members 80 transfer splitting forces from the webs 72 and the flanges 74 to the leg members 68. The exemplary edge members 80 are welded to the legs 60 such that they are flush with the legs 60.

The web members 72 are substantially vertical when the system 20 is in the split mode. The exemplary web members 72 are welded at their ends to the core member 76 and to one of the edge members 80. The web members 72 are also welded along their upper edges to the upper member 70 and along their lower edges to one of the flange members 74.

Figure 18:
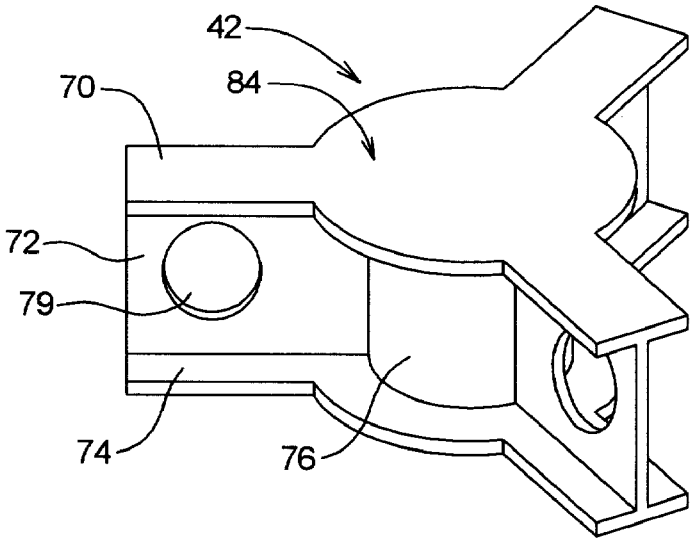
FIG. 18 is a perspective, partial cutaway view depicting an I-beam structure of the table assembly of the wood splitter of FIG. 1.

The structure resulting from the combination of the web members 72, upper member 70, and the flange member 74 is similar to that of an I-beam as illustrated in FIG. 18. More specifically, this structure features three terminal support points for the transfer of central forces at the work location 84 to the edge members 80, rather than to the legs 60.

FIG. 18 depicts the table structure 42 without the edge members 80 and with some but not all of the upper member 70 removed in a pattern that emphasizes the I-beam-like structure resulting from the web members 72, upper member 70, and flange members 74. This I-beam-like structure creates an extremely rigid structural reinforcement for the upper member 70 that allows this member 70 to bear loads much greater than if the member 70 was not reinforced or was reinforced by other means of similar weight (greater strength per unit of steel utilized). The I-beam structure thus reinforces the upper member 70 while reducing the overall weight of the table assembly 42.

FIG. 18 also shows that the exemplary web members 72 also feature web openings 79 that reduce the weight of these members 72 without significantly reducing the load bearing strength of the table assembly 42. These web openings 79 also allow the motor 34 and pump 50 to be securely mounted within the table assembly 42 as shown in FIG. 5 without being exposed to the user as perhaps best illustrated by the elevation view of FIG. 1.

The core member 76 is formed by a rigid structure that is capped by the center reinforcement 87 and then welded at its upper end to the upper member 70 and at its lower end to the container plate 78. The core member 76 thus defines a chamber that will be described in detail below with reference to the reservoir 52.

The exemplary core member 76 is cylindrical in shape and hollow. While other shapes may be used, the cylindrical shape is highly efficient at transmitting compression loads on one web member 72 to the other web members 72.

The exemplary table assembly 42 is capable of carrying loads of 72,000 pounds per square inch at the work location 84 and 36,000 pounds of continuous force anywhere on its surface, yet weighs less than 200 pounds. In addition, the table assembly 42 creates open spaces or hollows under the upper member 70 sufficient for the placement of the motor 34, pump 50, reservoir 52, and related hoses.

Figure 12:
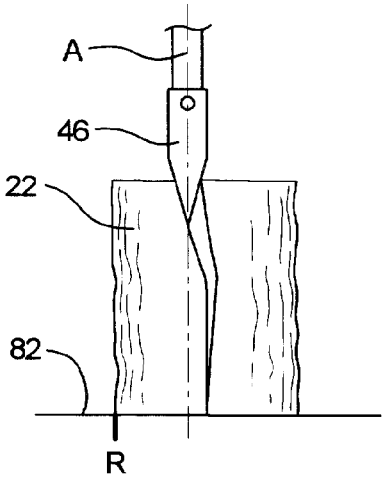
FIGS. 12 and 13 are front elevation views depicting the shifting of a workpiece under lateral loads created by uneven grain patterns.
Figure 13:
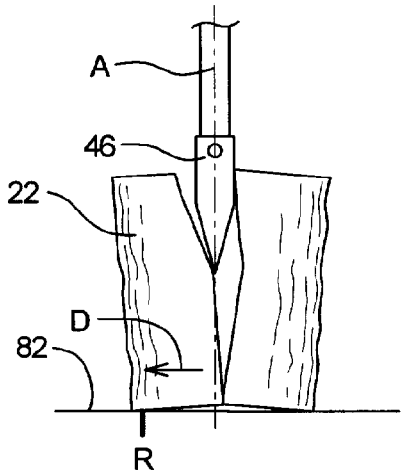

Referring now to FIGS. 12 and 13, depicted therein is a situation in which a split is being formed in a workpiece 22 with a knot therein. In this situation, the knot and grain pattern of the workpiece 22 tend to apply a lateral force on the wedge member 46 that results in a bending moment on the ram assembly 44. While the ram assembly 44 is designed to handle the loads created by such bending moments, the system 20 as designed inherently limits such loads. In particular, the wedge member 46 is suspended in free space, and the work surface 82 is made of a smooth, low friction material such as a typical milled steel plate.

The workpiece 22 is thus allowed to move laterally as shown by arrow D in FIG. 13. The reference character R in FIGS. 12 and 13 indicates a reference location a predetermined distance from the ram axis A. The edge of the workpiece 22 is aligned with the reference location R in FIG. 12 and offset slightly from this location R in FIG. 13; this offset corresponds to the shift in location of the workpiece 22 relative to the ram axis A. In use, the workpiece 22 may jump or skip in one or more small increments during a single split cycle of the system 22. This lateral movement of the workpiece 22 reduces loads on the ram assembly 44 and thus may prolong the life of one of the more expensive components of the system 22.

In addition, the side forces have limited effect on the legs 60 other than to increase tension levels in some of the legs 60 and decrease these tension levels in other legs 60.

When the table assembly 42 is supported by the support structure 40 and the legs 60 adjusted as described above, the work surface 82 formed by the table assembly 42 is substantially horizontal and at a convenient height for prolonged use by the operator 24. The workpiece 22 is lifted once to the height of the work surface 82 and then may be adjusted for the proper split pattern as will be described below while the operator 24 is standing substantially erect (FIG. 10). The table assembly 42 when supported by the support structure 40 thus places less strain on the operator 24. In addition, the system 20 when used by an experienced operator will split firewood at a relatively high rate. The table assembly 42 thus allows the operator 24 to use the system 20 more productively for a longer period of time than with prior art wood splitting systems.

C. Ram Assembly

Referring for a moment back to FIG. 17, that figure shows that the exemplary ram member 44 comprises a housing 90, a piston head 92, and a piston shaft 94 rigidly connected to the piston head 92. The housing 90 and piston head 92 define an UP chamber 96 and a DOWN chamber 98. The exemplary control valve assemblies 56 and 58 described above are typically mounted near the ram member 94. Hydraulic fluid forced into the DOWN chamber 98 while allowing fluid to flow out of the UP chamber 96 acts on the piston head 92 to extend the piston shaft 94 out of the housing 90. Forcing hydraulic fluid into the UP chamber while allowing fluid to flow out of the DOWN chamber 98 results in the piston shaft 94 being retracted into the housing 90.

The details of construction and operation of the ram assembly 44 are not an important part of the present invention, and any system capable of moving the wedge member 46 along the ram axis A with sufficient force to split the workpiece 22 may be substituted for the ram assembly 44.

The exemplary ram member 44 has a total stroke length of approximately 28 inches. However, the control system 32 is designed such that the ram member 44 moves the wedge member 46 a limited stroke length of only 20 inches, or approximately 70 percent of the total ram member stroke length. This over-sizing of the ram member 44 increases the ability of the ram assembly to bear bending moments applied on the piston shaft 94 when the shaft is at the bottom end of the limited stroke length.

When the system 20 is in the split mode, the ram assembly 44 is supported by the support structure 40 in a substantially vertical orientation. In addition, the ram assembly 44 suspends the wedge member 46 in free space for movement between a home position and an extended position. When the wedge member 46 is in the home position, the wedge member 46 defines the upper side of the work opening 86 as generally described above. A workpiece 22 that is longer than a predetermined length will thus not fit on the work location 84 under the wedge member 46 in its home position. The height of the wedge member 46 in the home position is thus predetermined to limit the length of the workpiece 22 placed at the work location 84. The exemplary system 20 limits the length of the workpiece 22 to twenty inches. A design goal of the system 20 is thus to increase the quality of the final product by limiting the final product to a length useable for generally accepted wood burning appliances.

D. Wedge Member

Figure 6:
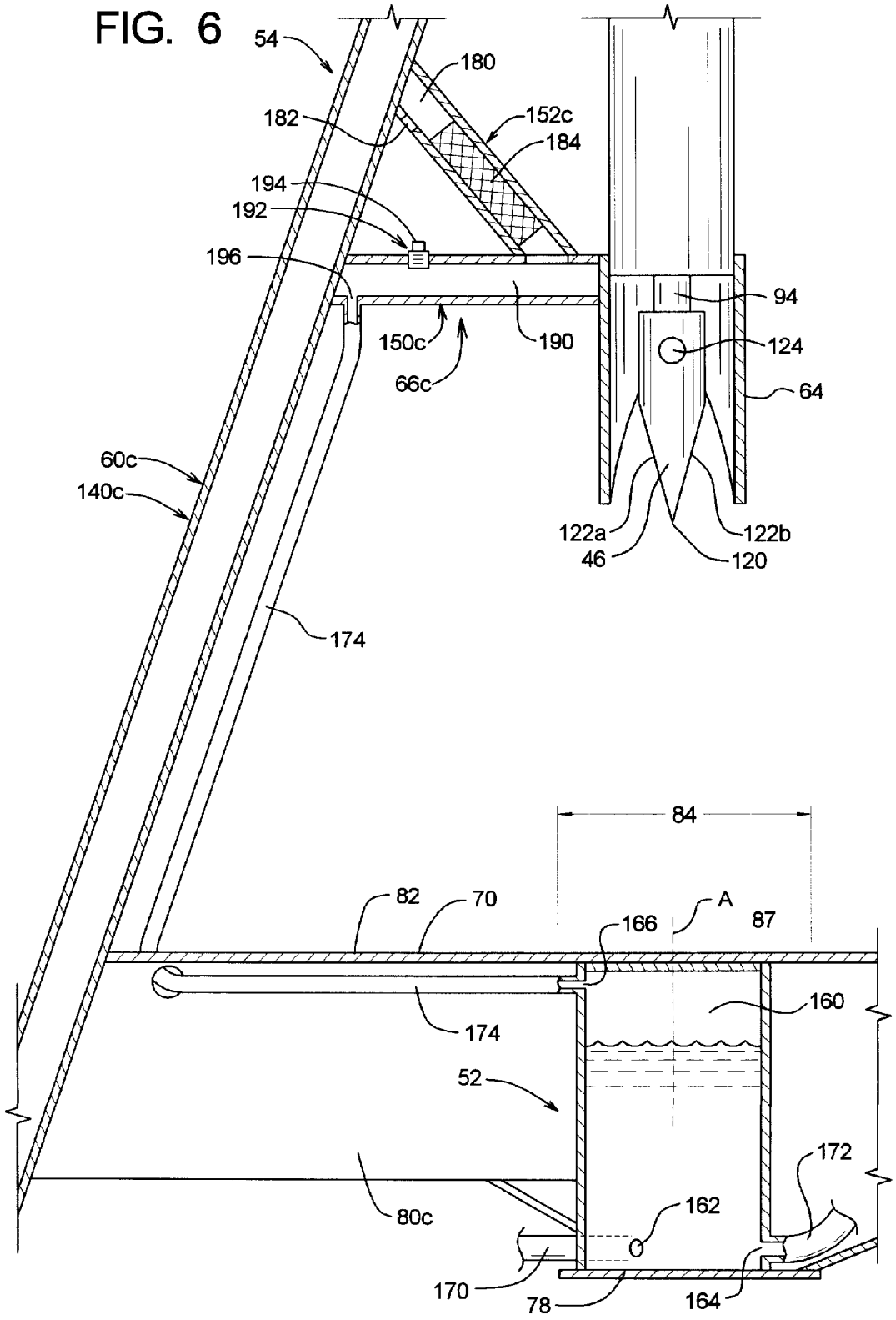
FIG. 6 is a side elevation partial cutaway view depicting a reservoir and vent/fill system of the hydraulic system of the wood splitter of FIG. 1.
Figure 7:
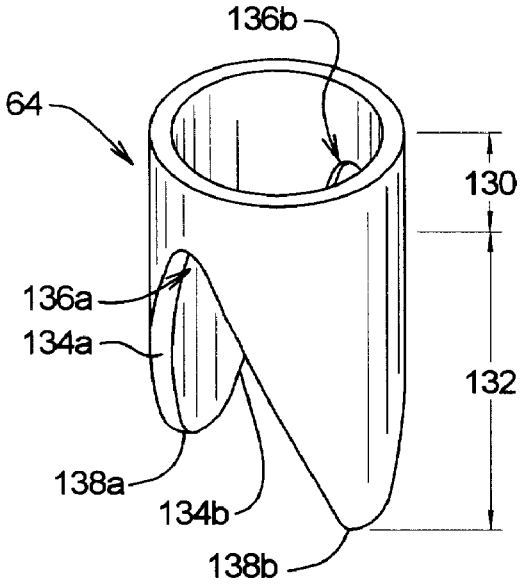
FIG. 7 is a perspective view of an exemplary lower collar member used by the wood splitter system of FIG. 1.

FIG. 6 illustrates that the exemplary wedge member 46 defines a tip portion 120, first and second wedge surfaces 122*a,b,* and one or more shaft guide members 124.

The wedge member 46 is securely mounted on the piston shaft 94 such that the tip portion 120 is distal from the shaft 94. The first and second wedge surfaces 122*a* and 122*b* extend upwardly and outwardly from the tip portion 120. The angle formed between the wedge surfaces 122*a* and 122*b* of the exemplary wedge member 46 is approximately thirty degrees and should in any event be within a range of twenty-five to thirty-five degrees.

The exemplary wedge member 46 is in this respect similar to the head of a maul and creates a mechanical advantage that aids in the splitting of the workpiece 22. In particular, the exemplary wedge member 46 has an effective cross-sectional area at the tip portion 120 of approximately one-half inch. The wedge member 46 thus converts the 36,000 pounds of force created by the control system to approximately 72,000 pounds per square inch of pressure where the wedge member 46 engages the workpiece 22. No natural fibers can withstand this pressure so the system 20 is seen to split all wood materials of any species or condition.

Figure 8:
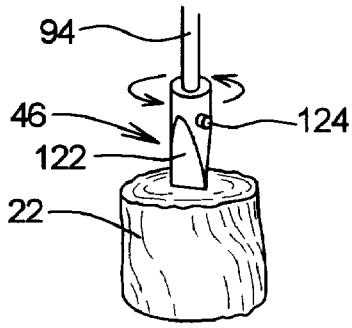
FIG. 8 is a perspective view of a portion of the wood splitter system of FIG. depicting the rotation of the wedge member thereof.

Referring now to FIG. 8, the arrows in that figure illustrate that the piston shaft 94 extends from the ram housing 90 such that the wedge member 46 may rotate about the ram axis A. Often the workpiece 22 defines a twisted grain pattern that tends to twist the wedge member 46 about the ram axis as the wedge member 46 moves downward into the workpiece 22 along the ram axis A.

The ability of the wedge member 46 to rotate in free space above the work location 84 allows the wedge member 46 to follow the grain patterns of the workpiece 22. This rotation reduces binding that would otherwise resist downward movement of the wedge member 46.

The descending, rotating wedge member 46 suspended above the work surface 82 creates an open working environment that does not restrict the ability of the operator 24 to position the workpiece 22 before each split. In contrast, most prior art wood splitters employ an I-beam for supporting a wedge guide adjacent to the ram axis; the I-beam and/or wedge guide is typically seen to interfere with placement of a workpiece along the ram axis.

Plotting the movement of a fixed point on the wedge member 46 in two dimensions results in a shaft path 126, and an exemplary shaft path 126 will be described below with reference to FIG. 11.

The exemplary shaft guide members 124 are solid pegs, typically steel, or, to reduce wear, can be formed by roller bearings.

If used, the shaft guide members 124 engage the exemplary lower collar 64 to return the wedge member 46 to a predetermined home orientation with respect to the support structure 40. The operator 24 thus knows when arranging the workpiece 22 at the work location 84 how the wedge surfaces 122*a,b* of the wedge member 46 are arranged. The operator 24 may thus arrange the grain pattern of or previous splits formed in the workpiece 22 to obtain enhanced splitting effect without first looking at the wedge member 46 to determine its actual orientation. In the exemplary system 20, the orientation is selected to be reminiscent of an operator swing a maul or axe.

Occasionally, a workpiece may split apart suddenly such that a piece may be thrown in a direction perpendicular to the wedge surfaces 122. Because the wedge member 46 is returned to its home orientation, such a thrown piece will usually move in a direction away from rather than towards the operator 24. In contrast, conventional wood splitters tend to direct such thrown pieces towards the operator.

The exemplary lower collar 64 defines an upper portion 130 and a housing portion 132. The housing portion 132 defines first and second guide surfaces 134 that in turn define home portions 136*a,b* and tip portions 138*a,b* of the collar 64.

Figure 11:
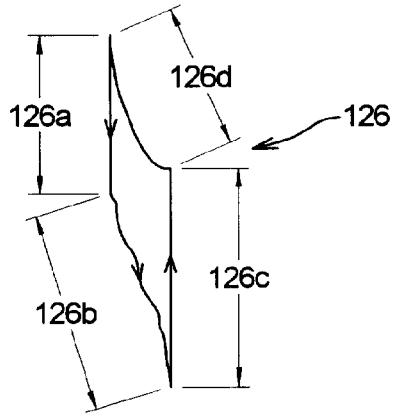
FIG. 11 is a plot of an exemplary shaft path of the wood splitter system of FIG. 1.

Referring now back to FIG. 11, depicted therein is the exemplary shaft path 126 that results when a freely rotating wedge member 46 engages a workpiece 22 having a twisted grain pattern and then is returned to a home position and orientation by the shaft guide members 124. The wedge member 46 starts in the home position and orientation (shaft guides 124 engaging the home portions 136*a,b*) and drops straight down along a first path portion 126a until the tip portion 120 engages the workpiece 22. At that point, the workpiece 22 twists the wedge member 46 as indicated by the lateral plot movement reflected in the second path portion 126*b*.

After the wedge member 46 reaches the bottom of its stroke, the wedge member 46 moves up along a fairly straight path identified by the third path portion 126*c* until the shaft guide 124 engages one of the guide surfaces 134*a,b*. At this point, as shown by the fourth path portion 126*d,* the guide surfaces 134*a,b* force the wedge member 46 to return to its home position and orientation.

The principles of the present invention may be applied without the shaft guide 124 and/or guide surfaces 134*a,b*. Alternatively, the shaft guide 124 and/or guide surfaces 134*a,b* may be formed within the housing 90 of the ram assembly 44. In either of these cases, the housing portion 132 of the collar 64 may be eliminated.

Figure 4:
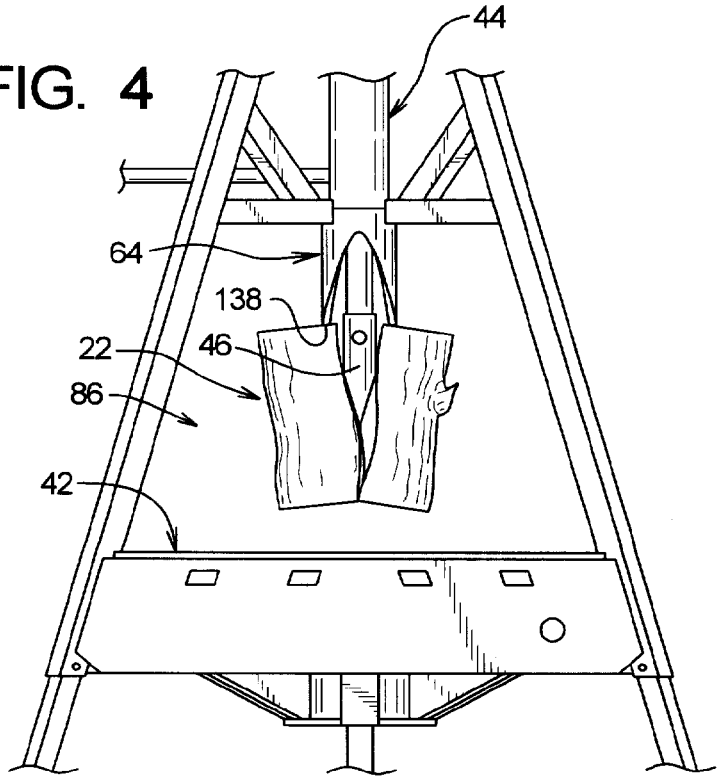
FIG. 4 is a partial elevation view of the wood splitter system of FIG. 1 in which a partially split workpiece is being automatically dislodged from a wedge member.

Providing the housing portion 132 provides other benefits to the system 20, however. As shown in FIG. 4, sometimes a workpiece 22 is not completely split, and the two cloven portions of the workpiece 22 hang onto the wedge member 46 at it is raised from the work surface 82. In this case, the housing tips 138 engage the workpiece 22 as the wedge member 46 is raised into its home position. The housing tips 138 will prevent further movement of the workpiece 22 and dislodge the workpiece 22 from the wedge member 46.

The optional housing portion 132 may thus be used even if no shaft guides 124 or guide surfaces 134 are used to return the wedge member 46 to a predetermined orientation. In this case, the primary function of the lower collar is to dislodge a workpiece that has become stuck on the wedge member 46.

Wedge members of different geometries may be used in place of the exemplary wedge member 46 described herein. For example, instead of the two wedge surfaces 122, the wedge member may have two twisted wedge surfaces, a flat blade without wedge features, may have a single conical wedge surface, or may have a plurality of wedge surfaces that form a wedge member having a generally cruciform cross-section that comes together at a point. The Applicant believes, however, that the exemplary wedge member 46 is preferred in most situations.

As will be described in further detail, the wedge member 46 of the exemplary system 20 moves between a home position (e.g., FIG. 1) in which the ram assembly 44 is retracted and an extended position in which the ram assembly 44 is extended to the full extent allowed by the control system 32.

And as described above, while the wedge member 46 may rotate 360 degrees about the ram axis A, the lower collar 64 may be configured to guide the wedge member 46 into a home orientation (FIG. 1) with respect to the support structure 40 and table assembly 42.

III. Control System

Referring now to FIG. 17, it can be seen that the control system 32 energizes the ram assembly 44 described above. In addition, the control system 32 may contain timing and logic that makes operation of the ram assembly 44 more convenient for the operator 24.

The exemplary control system 32 uses the flow of hydraulic fluid to power and control the ram assembly 44. However, as briefly discussed above, other mediums may be used to implement the power and control functions of the system 32. The use of a control system 32 is, however, preferred and will be described in detail herein.

The pump 50, control valves 56 and 58, and ram assembly 44 all are or may be conventional and will not be described in detail.

A. Pump and Motor

In the preferred embodiment, the motor 34 is an electric motor sized and dimensioned as to provide necessary power to the pump 50. As generally discussed above, the parameters of the wood splitter system 20 are preferably chosen such that the motor 34 is a two-horse electric motor. Such a motor is small enough to fit under the work surface 82 within the table assembly 42. Although gas or other types of motor may be used by the system 20 of the present invention, the use of an electric motor as the exemplary motor 34 yields a source of mechanical energy that is small, quiet, light, and clean. Even if used in an outdoor setting where utility power is not available, a generator may be coupled to the system 20 through a lightweight cord with the benefit of keeping the fumes and the noise away from the operator.

To improve cycling of the system 20 in split mode, the pump 50 is preferably a variable or mulit rate pump. When the pump is unloaded, the exemplary pump 50 operates at a first speed. When pressure within the pump 50 exceeds a predetermined threshold (e.g., 500 psi) indicating the presence of a load, the pump 50 gears down. The ratio of high to low speed in the exemplary pump 50 is approximately 4:1; such variable-rate pumps are conventional. Other types of pumps may be used if matched to the motor 34.

The exemplary pump 50 pressurizes the hydraulic fluid up to approximately 2,250 pounds per square inch. The exemplary piston head 92 has a cross-sectional area of approximately sixteen square inches. The exemplary combination of the pump 50 and the ram assembly 44 thus applies a force of up to approximately 36,000 pounds to the wedge member 46 as required.

As generally described above, prior art wood splitter systems are sized and dimensioned to require a high pressure source of pressurized hydraulic fluid and to require a high travel speed. Accordingly, the prior art wood splitter systems conventionally use gasoline engines.

In particular, the high pressure and high travel speeds dictate high pressure requirements according to the following formulas:

$$P=(F\times d)/t, \text{ or } P=F\times v;$$

where

P is power in watts;

F is force in newtons;

d is distance in meters; and v is velocity in meters/second.

Accordingly, using English units and including a reduction gear ratio, horsepower is calculated using the following formula:

$$Hp=(0.3035\times B\times R)/G,$$

where

Hp is theoretical horsepower;

B is blade force in tons;

R is travel rate in inches per second; and

G is the step down ratio.

Presuming a travel rate of four inches per second and a force of twenty tons, the theoretical horsepower required with a step down ratio of 1 (i.e., no step down) is twenty four. Practically speaking, this theoretical horsepower requirement dictates the use of a gasoline engine. Even assuming that the pump is a multi-ratio pump that gears down when loaded using a step down ratio of four, a five to seven horsepower engine is required; again, this horsepower requirement strongly suggests the use of a gasoline engine.

In contrast, the exemplary wood splitter system 20 described herein is sized and dimensioned to use a slower travel rate of 1.6 inches per second. With a step down ratio of four, the horsepower requirements suggest the use of a two to two and one-half horsepower motor. The exemplary wood splitter system 20 of the present invention thus uses a two horsepower (two and one-half Hp peak), 240 VAC electric motor.

As described herein, an electric motor provides significant benefits to the operator 24 such as lower fatigue and lower chance of illness. These benefits to the operator 24 in turn result in a higher quality product because the operator 24 is less inclined to hurry through the job and thus undersplit the product.

B. Reservoir

The reservoir used by the control system 32 of the present invention also is or may be conventional, and reservoirs other than the exemplary reservoir 52 may be used to implement the principles of the present invention in its broadest form. The exemplary reservoir 52 is, however, preferred for reasons that will become apparent from the following discussion.

A hydraulic system typically uses an excess of hydraulic fluid, and this excess is typically stored in a reservoir. The exemplary reservoir 52 stores an adequate amount of hydraulic fluid for the purposes of the control system 32 but is sized and located in a manner that is preferred in the context of the exemplary table assembly 42.

In particular, as briefly described above, the core member 76 of the table assembly 42 defines a closed chamber when welded between the upper member 70 and the container plate 78. The exemplary control system 32 makes use of chamber defined by the core member 76 as a reservoir chamber 160 as shown in FIGS. 5 and 6. The core member 76 thus functions both as an efficient structural component of the table assembly 42 and as a significant part of the reservoir 52 of the control system 32. FIGS. 5 and 6 further show that an inlet port 162, an outlet port 164, and vent port 166 are formed in the core member 78 to allow fluid to flow into and out of the reservoir chamber 160.

FIG. 17 shows that the inlet port 162 is connected to a return hose 170, the outlet port 164 is connected to a suction hose 172, and the vent port 166 is connected to a vent hose 174. FIG. 17 further illustrates that a pressure hose 176 is connected to the pump 50. These hoses 170–176 are also shown in FIG. 5, which also shows that a filter 178 is arranged in the return hose 170.

As shown by arrows in FIG. 17, the control system 32 causes fluid to flow in a path or circuit from the reservoir 52, to the pump 50, through the control valve 56, ram assembly 44, and control valve 58, and back into the reservoir 52. Between the pump 50 and the reservoir inlet 162, the fluid is pressurized. The fluid is substantially at atmospheric pressure in the reservoir 52. At the level shown in FIG. 17, the control system 32 is or may be conventional.

The arrangement of the inlet port 162, an outlet port 164, and vent port 166 in the core member 76 is planned to enhance the function of the control system 32 and more specifically the reservoir 52. In particular, as shown in FIGS. 5 and 6, the inlet port 162 and outlet port 164 are both formed in the side wall of the core member 76 at or near the bottom of the reservoir chamber 160. The vent port 166 is formed in the side wall of the member 76 at or near the top of the reservoir chamber 160. This arrangement allows air entrained in the fluid entering the chamber 160 through the inlet port 162 to rise to the top of the chamber 160. Any such air may thus exit the chamber 160 through the vent port 166, vent hose 174, and eventually the vent/fill system 54.

Additionally, as shown in FIG. 5, the inlet port 162 defines an inlet port axis B and the outlet port 164 defines an outlet port axis C. Fluid entering the reservoir chamber 160 through the inlet port 162 flows, at least initially, along the inlet port axis B. Similarly, fluid drawn out of the reservoir chamber 160 through the outlet port 164 flows along the outlet port axis C, at least in the region of the chamber 160 near the outlet port 164.

In the exemplary system 20, these inlet and outlet port axes B and C are not aligned with each other. If these axes B and C are aligned, coupling between the ports 162 and 164 will be approximately one hundred percent. The fluid thus will pass directly through the reservoir chamber 160 without mixing with the fluid in the reservoir 52, causing the fluid to rapidly overheat.

With the angled axes B and C of the exemplary reservoir chamber 160, fluid entering the chamber 160 through the inlet port 162 does not flow directly through the chamber 160 and into the outlet port 164. Instead, the fluid flowing through the inlet port 162 tends to flow in indirect path through the chamber 160. This indirect path allows mixing of the newly introduced fluid with the stored fluid. Entrained air thus rises to the surface, any sediment in the fluid is prevented from accumulating in the reservoir 52, and the newly introduced fluid is cooled by the stored fluid. Any such sediment thus may be carried through the control system 32 and be removed by the filter 178 in the return hose 170. The angle between the inlet port axis B and outlet port axis C is thus non-zero and is preferably in the range of between ninety to one hundred fifty degrees and is preferably one hundred twenty degrees.

Again, while the reservoir used by the present invention may be conventional, the exemplary reservoir 52 described herein makes best use of the volume and structure already provided by the system 20. The exemplary reservoir 52 also is designed to facilitate the removal of air, sediment, and heat from the hydraulic fluid. The system 20 meets these objectives for the reservoir 52 and thus reduces the likelihood of possible malfunction in the control system 32 which could harm the operator 24.

Another function of the reservoir 52 is to cool the hydraulic fluid stored therein. Heat in the fluid will transfer through the core member 76 and into the other structural components of the table assembly 42. The use of the core member 76 to form the reservoir integrally with the table assembly 42 thus reduces the likelihood that the hydraulic fluid used by the control system 32 will overheat.

The reservoir 52 of the present invention is smaller than what would ordinarily be used in a control system such as the control system 32 described herein. Typically, a reservoir of between six and twelve gallons would be used to ensure adequate cooling and accommodate sedimentation of impurities and removal of entrained air.

However, because of the arrangement of inlet and outlet ports 162 and 164 and the fact that the reservoir 52 is incorporated into the table assembly 42, the exemplary reservoir chamber 160 is designed to hold only approximately two gallons of hydraulic fluid.

The arrangement of inlet and outlet ports 162 and 164 allows air to percolate up through the fluid in the chamber 160 and also stirs up impurities for removal by the filter 178 and thus avoids significant sedimentation; the use of a large reservoir to collect sediment is thus unnecessary. In addition, the conventional large reservoir provides a mass of hydraulic fluid that is conventionally considered necessary to keep the control system cool. However, the cooling effect of the table assembly 42 allows the smaller volume of the chamber 160 to be used while still avoiding overheating of the exemplary control system 32. In the device 20, even the fan of the motor 34 assists in air circulation and cooling of the structure surrounding the core member 76

C. Vent/Fill System

Referring now for a moment back to FIG. 6, depicted therein in further detail is the exemplary vent/fill system 54 used by the wood splitter system 20. The vent/fill system 54 allows air to enter and exit the reservoir chamber 160 as necessary and also allows hydraulic fluid to be added to the control system 32.

The exemplary venVfill system 54 uses a portion of the support structure 40 to define the ports and chambers that allow the vent/fill system 54 to perform its functions. More specifically, the vent/fill system 54 uses the structure of one of the bracing assemblies 66 to allow air to flow out of and hydraulic fluid to be introduced into the control system 32.

As generally described above, the bracing assemblies 66 comprise a lateral member 150 and an angle member 152. The exemplary members 150 and 152 are formed of hollow, tubular steel having a rectangular cross-section. The interior of the angle member 152 defines a vent chamber 180; a vent port 182 is formed in the angle member 152 to allow air to enter and leave the vent chamber 180. Filter material 184 is arranged in the vent chamber 180 to prevent debris from entering the control system 32 through the vent port 182.

Similarly, the lateral member 150 defines a fill chamber 190. A fill port 192 is formed in the lateral member 150 to allow hydraulic fluid to be introduced into the fill chamber 190. A fill port plug 194 engages the fill port 192 to seal this port 192 when the port 192 is not in use. A reservoir port 196 is also formed in the lateral member 150, and the vent hose 174 is connected to the reservoir port 196.

The vent hose 174 thus allows fluid communication between the fill chamber 190 and the reservoir chamber 160. In addition, the vent chamber 180 is in fluid communication with the fill chamber 190; air may thus freely flow between the vent port 182 and the reservoir chamber 160. In addition, hydraulic fluid introduced through the fill port 194 will flow through the fill chamber 190 and the vent hose 174 into the reservoir chamber 160. Transfer is slow but assured during normal operation. Filling is seldom necessary as the exemplary control system 32 does not lose oil during normal operation.

The exemplary vent hose 174 is routed at least partly along the rear leg 60*c* as shown in FIG. 6. During use of the system 20 in the split mode, the fill chamber 190 is above the reservoir chamber 160, and gravity will prevent the hydraulic fluid from flowing out of the fill port 192 and/or vent port 182. During use of the system 20 in the tow mode, the part of the vent hose 174 along the rear leg 60*c* is above both the reservoir chamber 160 and the vent chamber 190. The vent hose 174 will thus prevent hydraulic fluid from leaking out of the fill port and/or vent port when the system 20 is in the tow mode.

Again, other fill and/or vent systems may be used as part of the control system 32 described herein, but the exemplary vent/fill system 54 described herein makes efficient use of the geometry and structure of the support structure 40 and is thus preferred. It is greatly objectionable for the control system 32 to lose any fluid at any time and the exemplary vent/fill system has been shown to avoid such fluid loss.

IV. Methods of Use

The exemplary wood splitter system 20 of the present invention described herein is used in the following manner.

Initially, as shown in FIG. 9 the system 20 will typically be placed in tow mode and with the wheel and tongue assemblies 26 and 28 attached thereto and towed to a desired location. Often, the system 20 will be placed in a convenient location such as a garage or barn and wood rounds brought to the system 20 from the point of harvest. In other situations, the system 20 may be towed to and set up at a remote location such as the point of harvest.

In any case, the wheel and tongue assemblies 26 and 28 are removed and the system 20 placed in an upright position and made ready for use in the split mode. Typically, power will be brought to the IS motor 34 and the fluid levels in the control system 32 are checked. In the preferred system 20, the legs 60 will be adjusted as necessary to accommodate the slope of the ground, if necessary, and such that the height of the work surface 82 is desired for the particular operator or operators 24.

At this point, the system 20 is ready for use. Typically, a wood round forming the workpiece 22 is placed on the work surface 82 through the work opening 86 and is arranged at the work location 84. The exact arrangement of the workpiece 22 at the work location 84 will depend upon the size, grain pattern, and perhaps species of wood. The relatively wide work opening 86 and swept back nature of the legs 60 reduces interference with proper placement of the workpiece 22 at the work location 84. FIG. 10 also illustrates an ergonomic closeness of work location 84 to the operator 24.

When the workpiece 22 is properly arranged at the work location 84, the control unit 88 is operated to cause fluid to flow from the pump 50 into the DOWN chamber 98 and out of the UP chamber 96 of the ram assembly 44. The ram assembly 44 thus forces the wedge member 46 down and through the workpiece 22. The control unit 88 may be reversed after a partial split is formed or after a complete split is formed. When the control unit 88 is reversed, the pump 50 causes fluid to force fluid into the UP chamber 96, and fluid is allowed to flow out of the DOWN chamber 98. The ram assembly 44 thus retracts the wedge member 46 back into the lower collar 64. The wedge member 46 is simultaneously returned to its home orientation if the shaft guide 124 and guide surfaces 134 come into use.

The workpiece 22 may then be rearranged on or removed from the work surface 82 in split patterns as necessary to split the workpiece into final product of a desired size.

Figure 14:
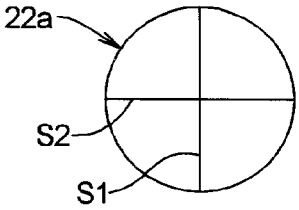
FIGS. 14–16 are exemplary split patterns formed using the wood splitter system of FIG. 1.
Figure 15:
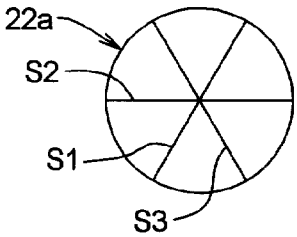
Figure 16:
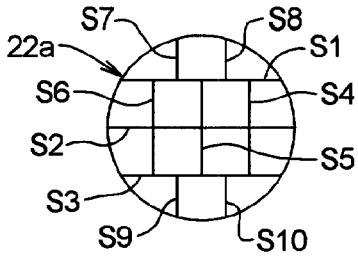

Referring now for a moment to FIGS. 14–16, depicted therein are top plan views of different split patterns for different exemplary workpieces. Each individual split formed by the system 20 is associated with a line segment and identified by the letter S and a number indicating the order in which the splits are formed.

Referring initially to FIG. 14, depicted therein is a split pattern appropriate for a relatively small diameter workpiece 22*a*. The workpiece 22*a* is split partly through once as shown at S1, rotated ninety degrees, and split a second time as shown at S2. This exemplary split pattern results in four pieces of approximately equal size for only two strokes of the wedge 46.

FIG. 15 depicts a split pattern for a workpiece 22*b* that is slightly larger than the workpiece 22*a* of FIG. 14. The workpiece 22 is split using three splits S1, S2, and S3 at an angle of approximately one hundred twenty degrees from each other. Again, the resulting pieces are approximately the same size and of an optimal size for burning and they were quickly prepared.

FIG. 16 shows a split pattern appropriate for a significantly larger workpiece 22*c*. The workpiece 22*c* is split with approximately ten different split strokes of the wedge member 46, resulting in fourteen different pieces of wood of the right size. The first six splits can be partial splits formed in a checkerboard pattern. When the wood is significantly weakened, one or two full splits can be formed to cause the entire workpiece 22*c* to separate into a number of smaller pieces.

The exact details of the split patterns and whether a full or partial split is formed depend upon the desired final product and the details of the particular workpiece 22. The experience of the operator 24 is an important factor in increasing the throughput of the wood splitter system 20. The operator 24 will prefer the device 20 because its upright, ergonomic, open, and free space work area allows greater control in placing the workpiece 22. The operator 24 can perform more total splits and in the correct locations yielding a higher quality in the final product.

From the foregoing, it should be clear that the present invention may be embodied in forms other than the one described above. The scope of the present invention should thus be determined by the following claims and not the foregoing detailed discussion.

I claim:

1. A wood splitter comprising:

a support structure comprising a plurality of legs each having a ground contacting portion and an upper portion, where the upper portions of the legs are connected at a support location;

a table assembly connected to each of the legs to form a work surface located below the support location;

a ram assembly supported from the support location above the work surface, where the ram assembly defines a ram axis;

a wedge member carried by the ram assembly; and a control system for operating the ram assembly to force the wedge member towards the work surface; wherein the legs are angled with respect to each other such that the legs intersect along the ram axis.

2. A wood splitter as recited in claim 1, in which, when the work surface supports a workpiece and the wedge member engages the workpiece, forces are applied substantially symmetrically to the legs and at least a portion of each of the legs is placed primarily in tension.

3. A wood splitter as recited in claim 1, in which the work surface is substantially horizontal during normal use.

4. A wood splitter as recited in claim 1, in which:

the ram assembly defines a ram axis extending through the support location and the work surface;

the ram assembly displaces the wedge member in free space along the ram axis; and the ram assembly supports the wedge member such that the wedge member may rotate about the ram axis as the wedge member is displaced along the ram axis.

5. A wood splitter as recited in claim 4, further comprising a collar member arranged to return the wedge member to a home orientation as the ram assembly retracts the wedge member along the ram axis towards the support location.

6. A wood splitter as recited in claim 5, in which the collar member is further arranged to remove a workpiece from the wedge member as the ram assembly retracts the wedge member along the ram axis towards the support location.

7. A wood splitter as recited in claim 1, further comprising a collar member arranged to remove a workpiece from the wedge member as the ram assembly displaces the wedge member along the ram axis towards the support location.

8. A wood splitter as recited in claim 1, in which the support structure comprises three legs.

9. A wood splitter as recited in claim 1, in which the work surface is arranged substantially between an ankle and a waist of the user during normal operation.

10. A wood splitter as recited in claim 1, in which the ram axis is substantially vertical during normal use.

11. A wood splitter as recited in claim 1, in which the table assembly comprises an upper member, a plurality of web members, and a plurality of lower members, where the web members are secured to the upper member and the lower members such that an I-beam structure is formed by each combination of one web member, the upper member, and one lower member.

12. A wood splitter as recited in claim 8, in which the work surface is substantially triangular.

13. A wood splitter as recited in claim 12, in which:

the work surface defines an operator edge along a front portion of the work surface that opposes a rear leg of the support structure;

an operator location is defined adjacent to the operator edge of the work surface;

the ram axis extends through the work surface at a work location; and the work location is located closer to the operator edge of the work surface than to the rear leg of the support structure.

14. A wood splitter as recited in claim 1, in which:

the control systems comprises a hydraulic system comprising a pump and a reservoir; and the reservoir is integrally formed with the table assembly.

15. A wood splitter as recited in claim 14, in which the table assembly comprises:

an upper member defining the work surface;

a core member defining the reservoir;

a plurality of web members; and a plurality of lower members; wherein the web members extend outwardly from the central wall, and are secured to the upper member and the lower members such that an I-beam structure is formed by each combination of one web member, the upper member, and one lower member.

16. A wood splitter as recited in claim 15, in which:

the support structure comprises three legs; and the table assembly further comprises three edge members; wherein each edge member is secured to the upper member and two adjacent legs such that the edge members support the upper member between the two adjacent legs; and each of the web members is secured to one of the edge members at a bracing location that is located substantially half-way between the adjacent legs between which the edge member extends.

17. A wood splitter as recited in claim 14, in which the reservoir defines an inlet port defining an inlet axis and an outlet port defining an outlet axis, where the inlet axis and the outlet axis are misaligned.

18. A wood splitter as recited in claim 1, in which the support structure defines:

a collar member for supporting a lower end of the ram assembly; and a plurality of bracing assemblies that extend from each of the legs to the collar member to brace the ram member such that the wedge member is arranged in free space above the work surface.

19. Awood splitter as recited in claim 18, in which:

one of the bracing assemblies defines a fill chamber and a fill port; and the control systems comprises a hydraulic system comprising a reservoir, a conduit connected between the reservoir and the fill chamber; whereby hydraulic fluid is introduced into the reservoir through the fill port, the fill chamber, and the conduit.

20. A wood splitter as recited in claim 18, in which:

one of the bracing assemblies defines a vent chamber and a vent port; and the control systems comprises a hydraulic system comprising a reservoir, a conduit connected between the reservoir and the vent chamber; whereby air is vented from the reservoir through the conduit, the vent chamber, and the vent port.

21. A wood splitter as recited in claim 18, in which:

one of the bracing assemblies defines a fill chamber, a vent chamber, a fill port, and a vent port, where the fill chamber is in fluid communication with the vent chamber; and the control systems comprises a hydraulic system comprising a reservoir, a conduit connected between the reservoir and the fill chamber; whereby hydraulic fluid is introduced into the reservoir through the fill port, the fill chamber, and the conduit; and air is vented from the reservoir through the conduit, the fill chamber, the vent chamber, and the vent port.

22. A wood splitter as recited in claim 20, further comprising a filter member arranged within the vent chamber.

23. A wood splitter as recited in claim 21, in which:

the wood splitter is configured to be transported in a prone position; and at least a portion of the conduit is above both the fill chamber and the vent chamber when the wood splitter is in the prone position.

24. A wood splitter as recited in claim 1, in which the legs comprise:

fixed leg members defining the upper portions; and movable leg members defining the ground contacting portions; wherein the fixed leg members are rigidly connected together at the support location and to the table assembly; and the movable leg members telescope within the fixed leg members to allow a distance between the work surface and each of the ground contacting portions to be altered.

25. A wood splitter as recited in claim 1, in which the support structure defines a work opening, where a height of the work opening is predetermined based on a stroke of the ram assembly to limit a length of the workpiece.

26. A wood splitter as recited in claim 1, in which the control system comprises:

a pump; and an electric motor for operating the pump.

27. A wood splitter comprising:

a support structure comprising a plurality of legs angled to intersect at a support location;

a table assembly supported at at least two locations by the support structure to form a substantially horizontal, substantially planar work surface located below the support location;

a ram assembly supported from the support location above the work surface, where the ram assembly defines a ram axis and the ram axis is substantially vertical;

a wedge member carried by the ram assembly; and control means for operating the ram assembly to force the wedge member along the ram axis towards the work surface.

28. A wood splitter comprising:

a support structure;

a table assembly connected to the support structure to form a work surface;

a ram assembly supported from the support structure relative to the work surface;

a wedge member carried by the ram assembly; and a control system comprising a pump for pressurizing fluid to operate the ram assembly to force the wedge member along the ram axis towards the work surface, and a reservoir for storing fluid, the reservoir being formed by a reservoir chamber defined at least in part by at least one structural component the table assembly.

29. A wood splitter comprising:

a support structure comprising a plurality of legs each having a ground contacting portion and an upper portion, where the upper portions of the legs are connected at a support location such that the legs are angled with respect to each other;

a table assembly connected to each of the legs to form a work surface located below the support location;

a ram assembly supported from the support location above the work surface;

a wedge member carried by the ram assembly; and a control system for operating the ram assembly to force the wedge member towards the work surface; whereby the ram assembly defines a ram axis extending through the support location and the work surface;

the ram assembly displaces the wedge member in free space along the ram axis; and the ram assembly supports the wedge member such that the wedge member may rotate about the ram axis as the wedge member is displaced along the ram axis.

30. A wood splitter as recited in claim 29, further comprising a collar member arranged to return the wedge member to a home orientation as the ram assembly retracts the wedge member along the ram axis towards the support location.

31. A wood splitter as recited in claim 30, in which the collar member is further arranged to remove a workpiece from the wedge member as the ram assembly retracts the wedge member along the ram axis towards the support location.

32. A wood splitter comprising:

a support structure comprising a plurality of legs each having a ground contacting portion and an upper portion, where the upper portions of the legs are connected at a support location such that the legs are angled with respect to each other;

a table assembly connected to each of the legs to form a work surface located below the support location;

a ram assembly supported from the support location above the work surface;

a wedge member carried by the ram assembly;

a control system for operating the ram assembly to force the wedge member towards the work surface; and a collar member arranged to remove a workpiece from the wedge member as the ram assembly displaces the wedge member along the ram axis towards the support location.

33. A wood splitter comprising:

a support structure comprising a plurality of legs each having a ground contacting portion and an upper portion, where the upper portions of the legs are connected at a support location such that the legs are angled with respect to each other;

a table assembly connected to each of the legs to form a work surface located below the support location;

a ram assembly supported from the support location above the work surface;

a wedge member carried by the ram assembly; and a control system for operating the ram assembly to force the wedge member towards the work surface; whereby the table assembly comprises an upper member, a plurality of web members, and a plurality of lower members, where the web members are secured to the upper member and the lower members such that an I-beam structure is formed by each combination of one web member, the upper member, and one lower member.

34. A wood splitter comprising:

a support structure comprising a plurality of legs each having a ground contacting portion and an upper portion, where the upper portions of the legs are connected at a support location such that the legs are angled with respect to each other;

a table assembly connected to each of the legs to form a work surface located below the support location;

a ram assembly supported from the support location above the work surface;

a wedge member carried by the ram assembly; and a control system for operating the ram assembly to force the wedge member towards the work surface; wherein the table assembly comprises:

an upper member defining the work surface;

a core member defining the reservoir;

a plurality of web members; and a plurality of lower members; wherein the control systems comprises a hydraulic system comprising a pump and a reservoir; and the reservoir is integrally formed with the table assembly.

35. A wood splitter as recited in claim 34, in which the table assembly comprises:

an upper member defining the work surface;

a core member defining the reservoir;

a plurality of web members; and a plurality of lower members; wherein the web members extend outwardly from the central wall, and are secured to the upper member and the lower members such that an I-beam structure is formed by each combination of one web member, the upper member, and one lower member.

36. A wood splitter as recited in claim 35, in which:

the support structure comprises three legs; and the table assembly further comprises three edge members; wherein each edge member is secured to the upper member and two adjacent legs such that the edge members support the upper member between the two adjacent legs; and each of the web members is secured to one of the edge members at a bracing location that is located substantially half-way between the adjacent legs between which the edge member extends.

37. A wood splitter as recited in claim 34, in which the reservoir defines an inlet port defining an inlet axis and an outlet port defining an outlet axis, where the inlet axis and the outlet axis are misaligned.

38. A wood splitter comprising:

a support structure comprising a plurality of legs each having a ground contacting portion and an upper portion, where the upper portions of the legs are connected at a support location such that the legs are angled with respect to each other;

a table assembly connected to each of the legs to form a work surface located below the support location;

a ram assembly supported from the support location above the work surface;

a wedge member carried by the ram assembly; and a control system for operating the ram assembly to force the wedge member towards the work surface; wherein the support structure defines:

a collar member for supporting a lower end of the ram assembly; and a plurality of bracing assemblies that extend from each of the legs to the collar member to brace the ram member such that the wedge member is arranged in free space above the work surface.

39. A wood splitter as recited in claim 38, in which:

one of the bracing assemblies defines a fill chamber and a fill port; and the control systems comprises a hydraulic system comprising a reservoir, a conduit connected between the reservoir and the fill chamber; whereby hydraulic fluid is introduced into the reservoir through the fill port, the fill chamber, and the conduit.

40. A wood splitter as recited in claim 38, in which:

one of the bracing assemblies defines a vent chamber and a vent port; and the control systems comprises a hydraulic system comprising a reservoir, a conduit connected between the reservoir and the vent chamber; whereby air is vented from the reservoir through the conduit, the vent chamber, and the vent port.

41. A wood splitter as recited in claim 38, in which:

one of the bracing assemblies defines a fill chamber, a vent chamber, a fill port, and a vent port, where the fill chamber is in fluid communication with the vent chamber; and the control systems comprises a hydraulic system comprising a reservoir, a conduit connected between the reservoir and the fill chamber; whereby hydraulic fluid is introduced into the reservoir through the fill port, the fill chamber, and the conduit; and air is vented from the reservoir through the conduit, the fill chamber, the vent chamber, and the vent port.

42. A wood splitter as recited in claim 40, further comprising a filter member arranged within the vent chamber.

43. A wood splitter as recited in claim 41, in which:

the wood splitter is configured to be transported in a prone position; and at least a portion of the conduit is above both the fill chamber and the vent chamber when the wood splitter is in the prone position.

44. A wood splitter comprising:

a support structure comprising a plurality of legs each having a ground contacting portion and an upper portion, where the upper portions of the legs are connected at a support location such that the legs are angled with respect to each other;

a table assembly connected to each of the legs to form a work surface located below the support location;

a ram assembly supported from the support location above the work surface;

a wedge member carried by the ram assembly; and a control system for operating the ram assembly to force the wedge member towards the work surface; in which the legs comprise:

fixed leg members defining the upper portions; and movable leg members defining the ground contacting portions; wherein the fixed leg members are rigidly connected together at the support location and to the table assembly; and the movable leg members telescope within the fixed leg members to allow a distance between the work surface and each of the ground contacting portions to be altered.

45. A wood splitter comprising:

a support structure comprising a plurality of legs each having a ground contacting portion and an upper portion, where the upper portions of the legs are connected at a support location such that the legs are angled with respect to each other;

a table assembly connected to each of the legs to form a work surface located below the support location;

a ram assembly supported from the support location above the work surface;

a wedge member carried by the ram assembly; and a control system for operating the ram assembly to force the wedge member towards the work surface; wherein the control system comprises:

a pump; and an electric motor for operating the pump.

* * * * *